US005203754A

United States Patent [19]

Maclean

[11] Patent Number: 5,203,754

[45] Date of Patent: Apr. 20, 1993

[54] VARIABLE RESISTANCE LEG HARNESS EXERCISE APPARATUS

[76] Inventor: Colin R. Maclean, 3229 Stone Eagle Ct., Abingdon, Md. 21009

[21] Appl. No.: 884,945

[22] Filed: May 18, 1992

[51] Int. Cl.[5] ..... A63B 21/02

[52] U.S. Cl. ..... 482/124; 482/121; 482/139

[58] Field of Search ..... 482/121, 122, 124, 125, 482/139

[56] References Cited

U.S. PATENT DOCUMENTS

| | | | |
|---|---|---|---|
| 650,656 | 5/1990 | Raabe | 482/124 |
| 843,478 | 2/1907 | Muller | 482/124 |
| 866,495 | 9/1907 | Marks | 482/124 |
| 1,618,273 | 2/1927 | Davidson | 482/124 |
| 4,606,542 | 8/1986 | Segal | 482/124 |
| 4,685,671 | 8/1987 | Hagerman et al. | 482/124 |
| 5,013,037 | 5/1991 | Stermer | 482/139 |
| 5,062,642 | 11/1991 | Berry et al. | 482/124 |
| 5,129,647 | 7/1992 | Castellanos | 482/124 |
| 5,137,272 | 8/1992 | Wilkinson | 482/124 |

FOREIGN PATENT DOCUMENTS

| | | | |
|---|---|---|---|
| 0150956 | 2/1932 | Switzerland | 482/124 |
| 21490 | of 1906 | United Kingdom | 482/124 |
| 0018341 | of 1908 | United Kingdom | 482/124 |

*Primary Examiner*—Robert Bahr
*Assistant Examiner*—Lynne A. Reichard
*Attorney, Agent, or Firm*—Donald A. Kettlestrings

[57] ABSTRACT

Variable resistance leg harness exercise apparatus includes a belt, leg attachments, foot attachments and stretchable cords attached to the belt and to the leg and foot attachments for enabling the user to perform under an increased load while not changing the user's natural center of gravity and without distorting the natural patterns of the exercise being performed.

18 Claims, 3 Drawing Sheets

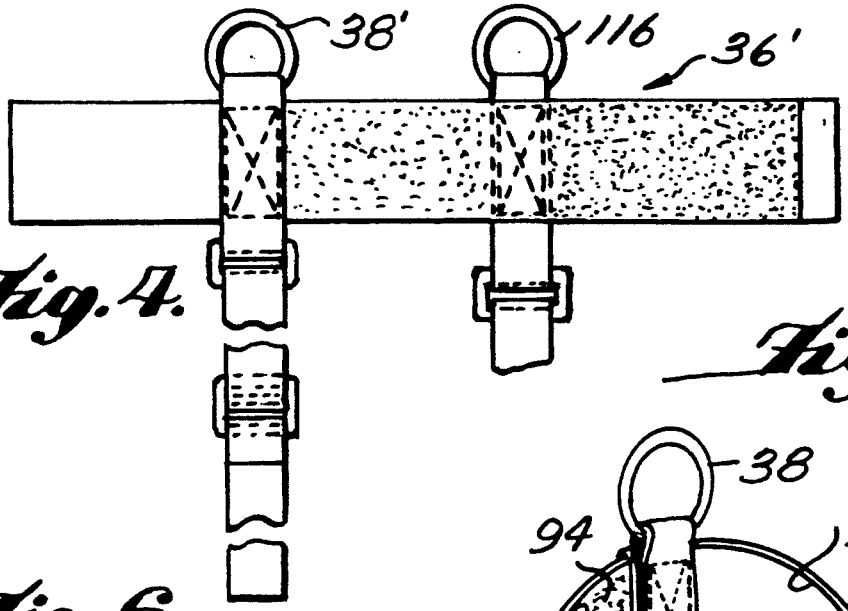
Fig. 4.
Fig. 5.
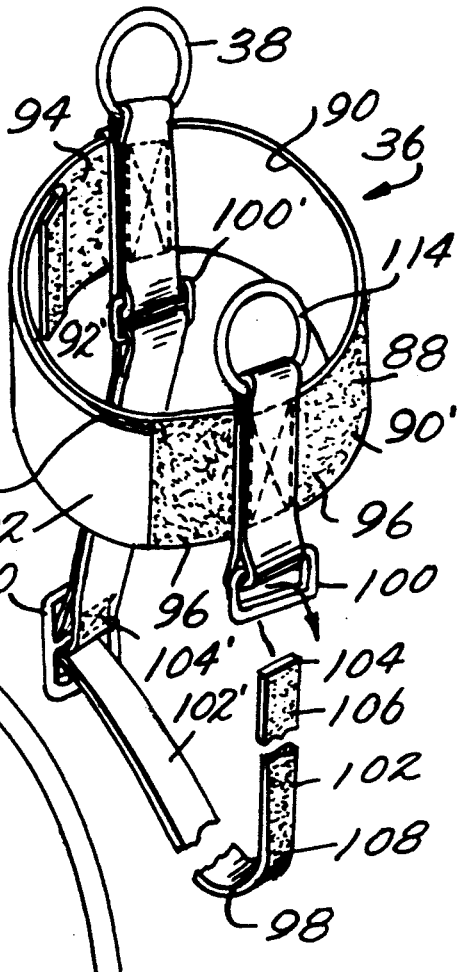
Fig. 6.
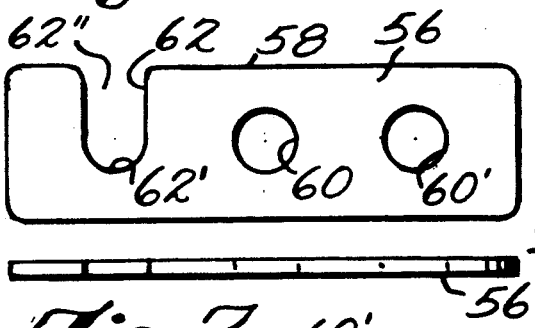
Fig. 7.
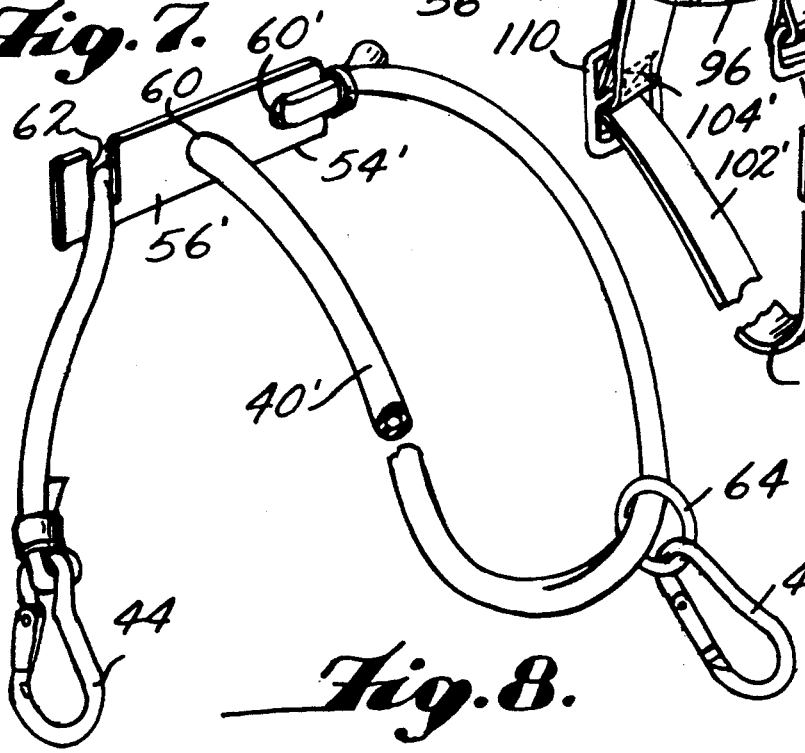
Fig. 8.

VARIABLE RESISTANCE LEG HARNESS EXERCISE APPARATUS

This invention relates to exercise apparatus and more particularly to a variable resistance leg harness exercise apparatus which enables the user to perform under an increased load on the user's legs while not distorting the user's natural center of gravity or movement patterns.

Various types of exercise devices and systems are known for increasing the load on the user's legs, but known devices and systems have not proved satisfactory under all conditions of service because they change the center of gravity of the user during use which effects the user's balance and distorts the natural movement patterns of the exercise.

It is, therefore, an object of the present invention to provide an exercise apparatus for overloading the user's legs and for increasing muscular strength and endurance of the legs.

Another object is to provide an exercise apparatus which can quickly and easily vary the load applied to the user's legs.

Another object is to provide an exercise apparatus that provides variable resistance loading that follows the structure of the user's legs.

A further object of the invention is the provision of exercise apparatus which allows for proper sequential firing of leg muscles with gradual and simultaneous loading occurring.

Still another object is to provide exercise apparatus which enables the user to perform exercise under an increased load while not changing the user's natural center of gravity and without distorting the natural movement patterns of the exercise being performed.

A still further object is to provide an exercise apparatus which allows for eccentric loading as well as concentric loading of the user's leg muscles.

Another object is to provide exercise apparatus which can be worn and used while the user trains for and performs a specific sport.

A further object of the invention is the provision of exercise apparatus which can be used during normal practice time by an athlete.

Another object is to provide exercise apparatus which strengthens primary and associative muscles both eccentrically and concentrically.

A still further object is to provide exercise apparatus which can be quickly and easily adjusted to increase or decrease the work load over a given time period.

A further object is the provision of exercise apparatus which can be used while performing sport specific agility and plyometric drills.

A still further object is to provide exercise apparatus which increases the energy exerted by a user within a predetermined time so that practice times need not be increased to result in an increase in energy output.

Another object is to provide exercise apparatus which improves neuromuscular response and motor skills.

Still another object is to provide exercise apparatus which improves coordination and which enables users to become more aware of their movement patterns.

A still further object is to provide exercise apparatus which can be worn with athletic footwear, such as cleats, skates and roller blades.

Another object is to provide exercise apparatus which does not develop excessive muscle mass but which increases the user's power and speed.

Another object is to provide exercise apparatus which is useful in rehabilitation.

Another object is to provide exercise apparatus in which movement patterns are low impact and non-ballistic.

Still another object is to provide exercise apparatus which can be used by itself or in conjunction with other closed chain modalities to overload leg muscles.

Another object is to provide exercise apparatus which may be used as a modality to isolate quadriceps muscles and to perform leg extensions.

Another object is to provide exercise apparatus which increases load for improved strength and endurance.

Another object is to provide exercise apparatus which is portable, light weight and durable.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides exercise apparatus, comprising: belt means for adjustable and removable attachment about the waist or midsection of a human user of the apparatus; first and second ring elements attached to the belt means for positioning above the illium on each side of the user, respectively, when the belt means is worn by the user; first and second strap means for adjustable and removable attachment about the legs and above the knees of the user; third and fourth ring elements attached to the first and second strap means, respectively, for positioning on outer sides of the legs when the strap means are worn by the user; first and second foot attachment means for removable attachment to the feet of the user; fifth and sixth ring elements attached to the first and second foot attachments, respectively, for positioning on outer sides of the ankles when the foot attachment means are worn by the user; a first stretchable cord of predetermined normal length and first and second connecting elements attached to the first cord for removable attachment of the first connecting element to the fifth ring element and for passing the first cord upwardly through the third and first ring elements to be stretched and removably reattached by the second connecting element to the fifth ring element; and a second stretchable cord of predetermined normal length and third and fourth connecting elements attached to the second cord for removable attachment of the third connecting element to the sixth ring element for passing the second cord upwardly through the fourth and second ring elements to be stretched and removably reattached by the fourth connecting element to the sixth ring element.

It is to be understood that both the foregoing general description and the following detailed description are exemplary and explanatory but are not restrictive of the invention.

The accompanying drawings, which are incorporated in and constitute a part of this specification, illustrate examples of preferred embodiments of the invention and, together with the description, serve to explain the principles of the invention.

FIG. 4 is a fragmentary elevation view of the left foot attachment;

FIG. 5 is a fragmentary perspective view showing the right foot attachment;

FIG. 6 is a plan view showing one of the adjusting bar elements used to adjust the overall length of the cords of the apparatus;

FIG. 7 is an elevation view of the adjusting bar element shown in FIG. 5;

FIG. 8 is a fragmentary perspective view showing an adjusting bar element attached to a cord of the apparatus.

Figure 1:
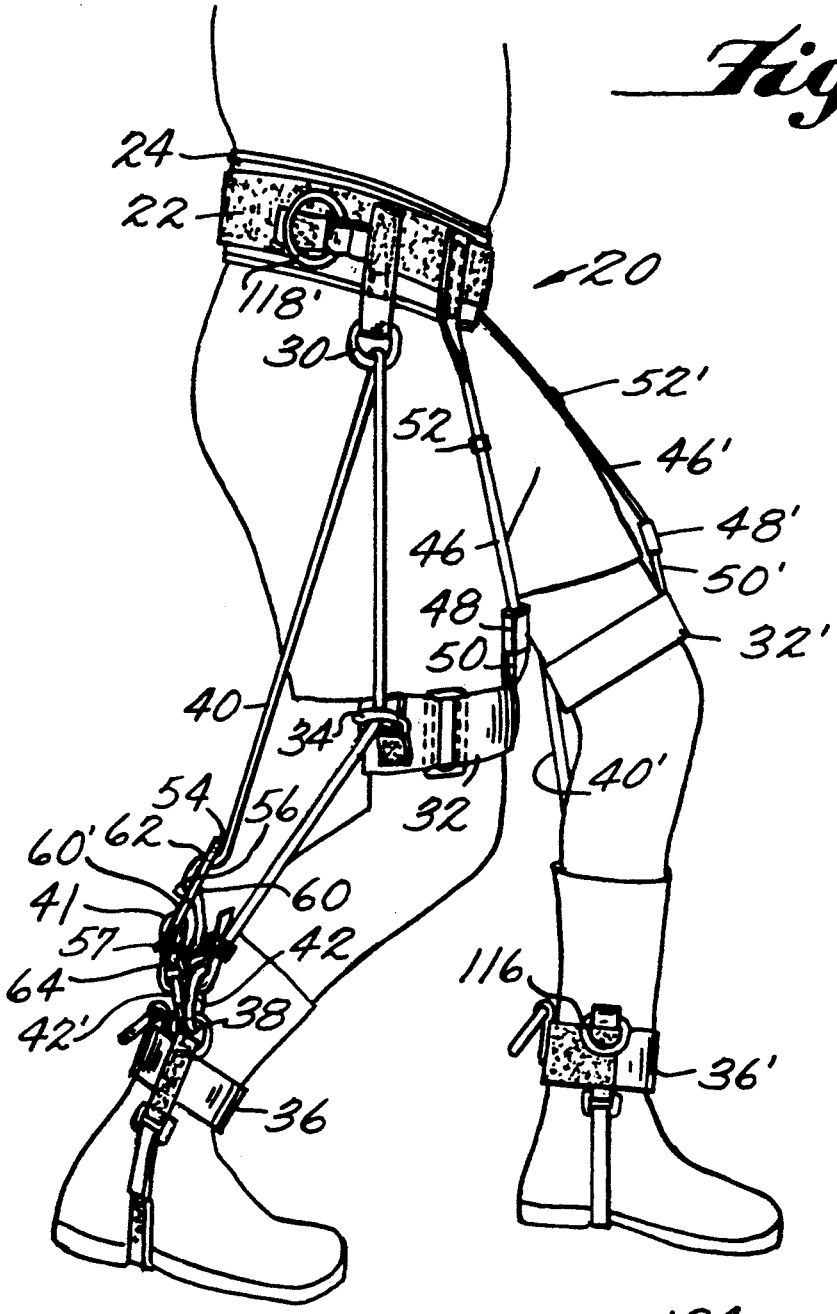
FIG. 1 is a fragmentary side elevation view showing the apparatus as worn by a user.

With reference now to the drawings, wherein like reference characters designate like or corresponding parts throughout the several views, there is shown in FIG. 1 exercise apparatus 20 in accordance with the invention. Apparatus 20 includes belt means 22 for adjustable and removable attachment about the waist or mid-section of a human user of apparatus 20. Belt 22 defines an outer surface 24, and belt 22 also includes a conventional slide or buckle 26 (FIG. 2) for slidably receiving end portion 28 of belt 22. Outer surface 24 at end portion 28 preferably defines hook-type material 29, as in Velcro, and outer surface 24 further defines loop-type material 31, as in Velcro. End portion 28 passes through slide 26, and materials 29 and 31 allow belt 22 to be adjustably fitted and held in position on the user.

First and second ring elements 30, 30' are attached to belt 22 for positioning above the illium on each side of the user when belt 22 is worn by the user. First and second leg strap means 32, 32' are provided for adjustable and removable attachment about the legs and above the knees of the user. Third and fourth ring elements 34, 34' are attached to strap means 32, 32', respectively. First and second foot attachment means 36, 36' also are provided for removable attachment to the feet and ankles of the user, and fifth and sixth ring elements 38, 38' are attached to foot attachments 36, 36', respectively.

Apparatus 20 further includes a first stretchable cord 40 of Latex or other similar stretchable material, and cord 40 is of a predetermined normal length as determined by the user's height. First and second connecting elements or snap hooks 42, 42' are attached to cord 40. Similarly, a second stretchable cord 40' of Latex or other similar material is provided of predetermined normal length, and third and fourth connecting elements or snap hooks 44, 44' are attached to cord 40'.

Apparatus 20 further includes first and second adjustable strap members 46, 46' attached to and extending downwardly from belt 22 for positioning over the thighs and quadriceps of the user. First and second fastening members 48, 48' are attached, respectively, to strap members 46, 46', and third and fourth fastening members 50, 50' are attached to leg strap means 32, 32', respectively, for removable connection with fastening members 48, 48'. Strap members 46, 46' can be adjustable in length by providing slide elements 52, 52' on strap members 46, 46', respectively.

Means 54, 54' are provided in operative relationship with cords 40, 40', respectively, for enabling adjustment of the overall lengths of the cords. In accordance with one preferred embodiment of the invention, adjusting means 54, 54' include first and second bar elements 56, 56', respectively, for use with cords 40, 40'. Each of bar elements 56, 56' defines at least a first lengthwise edge 58, and each of bar elements 56, 56' further defines first and second openings 60, 60' therein and a slot 62 having an end 62' and an open end 62". Open end 62" is in communication with lengthwise edge 58.

First cord 40 passes slidably through first opening 60 in first bar element 56. A first end 41 of first cord 40 passes through second opening 60' in first bar element 56 and is attached to first bar element 56 adjacent to second opening 60' by tying or by means of a clamp 57. The overall length of first cord 40 is adjustable by movement of cord 40 through first opening 60, and the overall length of cord 40 can be fixed and locked into position by removably inserting cord 40 into slot 62. In order to permit the adjustment of the overall length of cord 40, second connecting element 42' is attached in slidable relationship to cord 40. This can be accomplished by placing a ring element 64 in slidable relationship over cord 40 and by attaching connecting element 42' to ring element 64.

Second bar element 56' (FIG. 8) is used in the same manner to permit adjustment of the overall length of second cord 40'.

In accordance with the invention, left leg strap means 32' (FIG. 3) includes a first stretchable band member 66 defining first and second opposed sides 68, 68' and defining first and second ends 70, 70'. Loop-type material 72, such as in Velcro, is located on first side 68 of band member 66. Third ring element 34' is attached to first side 68 and adjacent to first end 70 of band member 66. First and second retaining members 74, 74' are attached to first and second ends 70, 70', respectively, of band member 66. A second band member 76 defines first and second opposed sides 78, 78' and first and second ends 80, 80'Hook-type material 82, as in Velcro, is located on first side 78 of band member 76, and loop-type material 84, as in Velcro, is located along a remaining portion of first side 78 of band member 76. A slide fastener 86 is connected to second end 80' of band member 76, and third fastening member 50' is attached to band member 76 and adjacent to second end 80' of band member 76. First end 80 of band member 76 slidably passes through second retaining member 74' and through slide fastener 86 so that the overall length of second band member 76 can be adjusted by adjustable movement of slide fastener 86 with respect to second band member 76. This is an importantfeature of apparatus 20 that allows leg strap 32' to be adjusted to fit different size legs while keeping ring element 34' on the outside of the leg and fastening member 50' on the front of the leg. Maintaining these positions is important for proper use of apparatus 20, as will be explained below.

First strap means 32 for attachment to the user's right leg is constructed in a manner identical to that of second strap means 32', but in mirrored relationship thereto. Strap means 32 is configured for attachment to the right leg of the user, and strap means 32' is configured for attachment to the left leg of the user.

In accordance with the invention, first foot attachment means 36 (FIG. 5) for attachment to the user's right foot and ankle preferably includes a stretchable ankle strap 88 defining first and second opposed sides 90, 90' and defining first and second ends 92, 92'. Hook-type material 94, as in Velcro, is located on first side 90 of ankle strap 88 adjacent to first end 92 of strap 88, and loop-type material 96, as in Velcro, is located on second side 90' of ankle strap 88 and adjacent to second end 92' of strap 88. An adjustable length foot strap 98 is attached to ankle strap 88, and fifth ring element 38 is attached to ankle strap 88 for positioning on the outer side of the right leg and above the ankle of the user when foot attachment means 36 is worn by the user.

First foot attachment 36 further includes first and second slide holder elements 100, 100' attached to ankle strap 88. Foot strap 98 defines first and second opposed sides 102, 102' and first and second ends 104, 104'. Hook-type material 106, as in Velcro, is located adjacent to first end 104 and on first side 102 of foot strap 98. Loop-type material 108, as in Velcro, is located adjacent to hook-type material 106 and on first side 102 of foot strap 98. A slide fastener 110 is connected to second end 104' of foot strap 98, and first end 104 of strap 98 slidably passes through slide holder 100', through slide fastener 110 and through slide holder 100 with hook-type material 106 attachable to loop-type material 108 so that the overall length of foot strap 98 can be adjusted by adjustable movement of slide fastener 110 with respect to strap 98.

In a preferred embodiment of apparatus 20, a seventh ring element 112 (FIG. 2) is attached to outer surface 24 of belt 22 for positioning substantially in the center of the lower back of the user when apparatus 20 and belt 22 are worn by the user. A preferred embodiment also includes eighth and ninth ring elements 114, 116 (FIGS. 4 and 5) attached to foot attachments 36, 36', respectively. Each of ring elements 114, 116 is attached for positioning on inner sides of the ankles when the foot attachments 36, 36' are worn by the user. A third stretchable cord (not shown) of Latex or other stretchable material and of a predetermined normal length also is provided, and fifth and sixth connecting elements (not shown) are attached to opposite ends of the third cord for removable attachment of the fifth connecting element to ring element 114 and for passing the third cord through ring element 112 to be stretched and removably attached by the sixth connecting element to ring element 116. This provides for additional loading of the leg muscles during use of apparatus 20.

The preferred embodiment further includes first and second ring members 118, 118' (FIG. 2) attached to outer surface 24 of belt 22 for respective positioning on each side and above the hips of the user when apparatus 20 and belt 22 are worn by the user. Additional stretchable cords (not shown) can be removably attached to ring members 118, 118' for enabling the user to work on lateral strength by pulling against the stretchable cords attached to ring members 118 or 118'.

Another embodiment of the invention provides for first and second adjustable suspender straps (not shown) to be permanently or removably attached to belt 22 for fitting over the shoulders of the user to provide additional support and comfort.

Another embodiment provides for foot attachment means 36, 36' to be conventional footwear 122, (FIG. 9) such as athletic shoes, roller blades or skates, and each of footwear items 22 preferably includes ring elements 124, 126 and 128. Ring element 124 is positioned to be located on the outer side of the ankle of the user, ring element 126 is positioned to be located on the inner side of the user's ankle, and ring element 28 is positioned to be located above the rear portion of the user's heel. The third stretchable cord (not shown) can be passed through ring element 112 on belt 22 and attached at each end to ring elements 128 on each shoe 122 to provide for additional exercise options with apparatus 20.

In use, belt 22 is positioned around the waist or midsection of the user with slide or buckle 26 positioned substantially in the center of the user's body. End portion 28 is passed through buckle 26 and belt 22 is comfortably tightened by engaging hook-type material 29 on end portion 28 with loop-type material 31 located on outer surface 24 of the belt. Quad straps or strap members 46, 46' will hang downwardly from belt 22 and will be positioned in front of the user's legs.

Leg straps 32, 32' are then attached to the user's legs. For example, left leg strap 32', (FIG. 3) is attached to the user's left leg by initially positioning stretchable band 66 behind the user's left leg and above the knee. Ring element 34' is located on the outside of the user's left leg and above the knee. Fastening member 50' must be positioned in front of the user's left leg so that fastening members 48', 50' can be removably connected together. The proper positioning of ring element 34' and of fastening member 50' is accomplished by adjusting the position of slide fastener 86 with respect to band member 76 until leg strap 32' properly fits the user's left leg.

Band member 76 is adjusted to the desired length by adjustment of slide fastener 86 with respect to band member 76. End 80 of band member 76 is then wrapped around the user's left leg and passes through retaining member 74. End 80 is then doubled back around retaining member 74 and hook-type material 82 adjacent to end 80 is releasably fastened to loop-type material 84 on band member 76 to firmly hold strap 32' in proper position on the user's left leg. Depending upon the size of the user's leg, hook-type material 82 adjacent to end 80 of band member 76 may releasably engage loop-type material 72 on stretchable band member 66 or loop-type material 84 on band member 76 when strap 32' is firmly wrapped around the user's leg.

Adjustable quad strap member 46' (FIGS. 2 and 3) is attached to leg strap 32' by conventional snap connectors 48', 50'. Quad strap 46' can be adjusted in length by movement of slide element 52' with respect to strap 46'. Strap 46' should be taut but not tight. Leg strap 32 is attached to the user's right leg in the same manner, and leg strap 32 is constructed as a mirror image of leg strap 32' to accommodate the anatomy of the user's right leg.

Foot and ankle attachments 36, 36' are then attached to the feet and ankles of the user. For example, attachment 36, (FIG. 5) is attached to the right foot and ankle of the user by initially positioning stretchable ankle strap 88 behind the user's right leg and above the ankle with first side 90 in contact with the user's leg. Simultaneously, foot strap 98 is positioned beneath the arch of the right foot or shoe of the user. Strap 88 is stretched and firmly wrapped around the user's right leg, and strap 88 is fastened by engaging hook-type material 94 with loop-type material 96 on strap 88.

The overall length of foot strap 98 can be adjusted by movement of slide fastener 110, and foot strap 98 is fastened into position by passing end 104 of strap 98 through slide holder element 100 and by doubling back end 104 so that hook-type material 106 on strap 98 engages loop-type material 108. Ankle strap 88 is positioned so that ring element 38 is positioned on the outside of the user's right leg and above the ankle. Foot attachment 36 is attached to the user's ankle and foot so that slide fastener 110 is positioned on the outside of the user's ankle.

When fastening foot strap 98, it is made easier if the right foot is raised off the ground. Foot strap 98 is threaded through slide holder element 100, and the overall length of foot strap 98 is adjusted by slide fastener 110 so that ankle strap 88 is level across the front of the user's shin. It is important that slide fastener 110 is not positioned beneath the foot. It is also important to take up as much slack as possible in foot strap 98 before attaching together hook and loop material 106, 108. To insure a strong bond between hook and loop material 106, 108, the user should pull upwardly on ring element 114 as hook and loop materials 106, 108 are pushed together.

Stretchable cords 40, 40' are then attached in an identical manner. For example, connecting element or snap hook 42 on cord 40 (FIG. 1) is passed through ring element 30 on the user's right side. Hook or snap element 42 is then passed downwardly through ring element 34 on leg strap 32. Connecting element or snap hook 42 is then attached to ring element 38 on the outer portion of foot attachment 36. The opposite end of stretchable cord 40, having connecting element or snap hook 42' slidably attached thereto by ring element 64 is then drawn downwardly and connecting element 42' is attached to outer ring element 38 of foot attachment 36.

To adjust tension in stretchable cord 40, the user must bend his knees to release tension on cord 40. With the knees bent, bar element 56 is pulled upwardly or downwardly in sliding relationship with respect to cord 40 to create the desired overall length for cord 40 and to create the desired resistance. Cord 40 is then locked into position with respect to bar element 56 by sliding cord 40 into slot 62 of bar element 56. It is important to adjust the position of cord 40 as it passes through ring element 30 on belt 22 to make sure that cord 40 has properly moved through ring element 30 to accommodate the new tension on cord 40. Sometimes cord 40 will stick in ring element 30.

Various alternative uses and configurations are possible with respect to apparatus 20. For example, one alternative configuration provides for stretchable cords of shorter lengths (not shown) than those of cords 40, 40'. Cords of various lengths can be used depending upon the height of the user. In the alternative configuration, connecting element or snap hook 42 is passed upwardly through ring element 34 on the user's right leg and connecting element or snap hook 42 is then attached to ring element 30 on belt 22. Connecting element or snap hook 42' is then attached to ring element 38 on foot attachment 36. Cord 40' is then similarly attached to the left side of the user.

Figure 9:
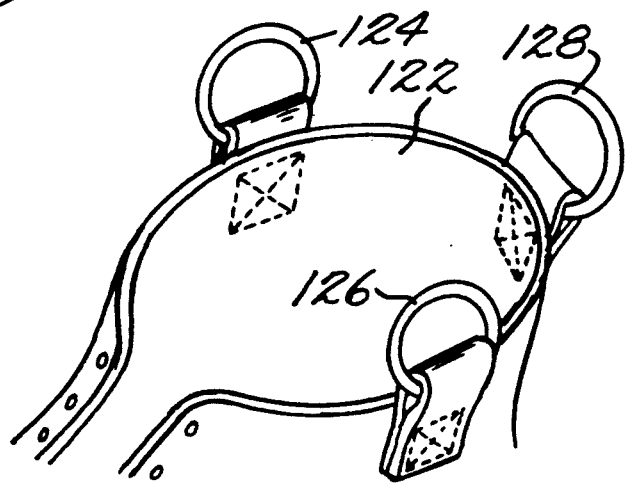
FIG. 9 is a fragmentary perspective view showing an alternative structure of a foot attachment of the apparatus.

Another alternative embodiment of the invention provides for foot attachment means 36, 36' to be athletic shoes 122 (FIG. 9). In this configuration, ring elements 124, 126 and 28 are attached directly to athletic shoe 122. Roller skates, roller blades or other types of footwear can be used in place of athletic shoes 122 so that apparatus 20 can be worn and used for various types of activities.

Figures 2, 3:
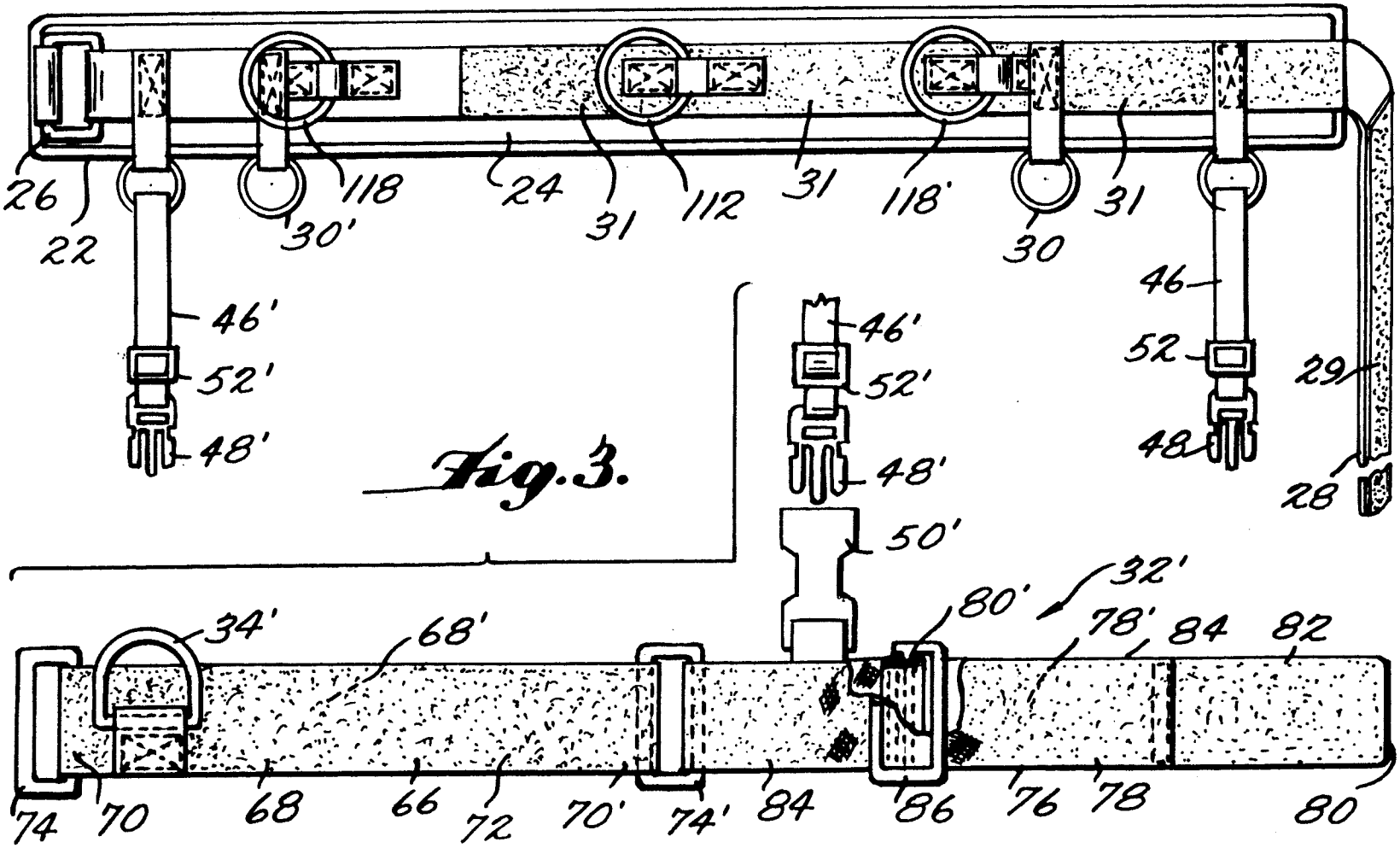
FIG. 2 is an elevation view showing the belt portion of the apparatus.
FIG. 3 is a fragmentary elevation view showing the left leg attachment to be connected to the belt.

Another use of apparatus 20 provides for stretchable cords (not shown) to be releasably attached to one or both of ring members 118, 118' (FIG. 2). This configuration enables the user to work on lateral strength by pulling against the stretchable cords in lateral directions.

Another alternative configuration and use of apparatus 20 provides for another stretchable cord (not shown) which is provided with connecting elements or snap hooks at each end of the cord. One of the snap hooks is passed through ring element 112 (FIG. 2) on belt 22 and that snap hook is attached to ring element 114 of foot attachment 36. The other connecting element or snap hook on the stretchable cord (not shown) is attached to ring element 116 on foot attachment 36'. This provides for increased loading of the user's muscles.

This invention provides for a variable resistance leg harness exercise apparatus which enables the user to perform under an increased load while not changing the user's natural center of gravity and without distorting the natural movement patterns of the exercise being performed. The invention in its broader aspects is not limited to the specific details shown and described, and departures may be made from such details without departing from the principles of the invention and without sacrificing its chief advantages.

What is claimed is:

1. Exercise apparatus, comprising:

belt means for adjustable and removable attachment about the waist or mid-section of a human user of said apparatus;

first and second ring elements attached to said belt means;

first and second strap means for adjustable and removable attachment about the legs and above the knees of said user;

third and fourth ring elements attached to said first and second strap means, respectively;

first and second foot attachment means for removable attachment to the feet of said user;

fifth and sixth ring elements attached to said first and second foot attachments, respectively;

a first stretchable cord of predetermined normal length and first and second connecting elements attached to said first cord for removable attachment of said first connecting element to said fifth ring element and for passing said first cord upwardly through said third and first ring elements to be stretched and removably reattached by said second connecting element to said fifth ring element; and a second stretchable cord of predetermined normal length and third and fourth connecting elements attached to said second cord for removable attachment of said third connecting element to said sixth ring element and for passing said second cord upwardly through said fourth and second ring elements to be stretched and removably reattached by said fourth connecting element to said sixth ring element.

2. Apparatus as in claim 1 further including:

first and second adjustable strap members attached to and extending downwardly from said belt means for positioning over the thighs and quadriceps of said user;

first and second fastening members attached, respectively, to said first and second strap members; and third and fourth fastening members attached, respectively, to said first and second leg strap means for removable connection with said first and second fastening members, respectively.

3. Apparatus as in claim 2 further including means in operative relationship with said cords for adjusting the overall lengths of said cords.

4. Apparatus as in claim 3 wherein said adjusting means include first and second bar elements for use with said first and second cords, respectively, each of said bar elements defining at least a first opposed lengthwise edge, and each of said bar elements further defining first and second openings therein and defining a slot having a closed end and an open end in communication with said first lengthwise edge, whereby the overall length of said cords can be quickly and easily adjusted by use of said bar elements.

5. Apparatus as in claim 4 wherein said first cord passes slidably through said first opening in said first bar element and wherein a first end of said first cord passes through said second opening in said first bar element and is attached to said first bar element adjacent to said second opening of said first bar element, the overall length of said first cord being adjustable by movement of said first cord through said first opening of said first bar element and said overall length of said first cord being fixed by removable insertion of said first cord into said slot in said first bar element.

6. Apparatus as in claim 5 wherein said second connecting element on said first cord is attached in slidable relationship to said first cord.

7. Apparatus as in claim 6 wherein said second cord passes slidably through said first opening in said second bar element and wherein a first end of said second cord passes through said second opening in said second bar element and is attached to said second bar element adjacent to said second opening of said second bar element, the overall length of said second cord being adjustable by movement of said second cord through said first opening of said second bar element and said overall length of said second cord being fixed by removable insertion of said second cord into said slot in said second bar element.

8. Apparatus as in claim 7 wherein said second connecting element on said second cord is attached in slidable relationship to said second cord.

9. Apparatus as in claim 3 wherein said first strap means includes:

a first stretchable band member defining first and second opposed sides and first and second ends;

loop-type material located on said first side of said first band member;

said third ring element attached to said first side and adjacent to said first end of said first band member;

first and second retaining members attached to said first and second ends, respectively, of said first band member;

a second band member defining first and second opposed sides and first and second ends; opposed sides and first and second ends;

hook-type material located on said second side of said second band member and loop-type material located along a remaining portion of said second side of said second band member;

a slide fastener connected to said second end of said second band member;

said third fastening member attached to said second band member and adjacent to said second end of said second band member; and said first end of said second band member slidably passing through said second retaining member and through said slide fastener whereby the overall length of said second band member can be adjusted by adjustable movement of said slide fastener with respect to said second band member.

10. Apparatus as in claim 3 wherein said first foot attachment means includes:

a stretchable ankle strap defining first and second sides and first and second ends;

first hook-type material located on said first side of said ankle strap adjacent to said first end of said ankle strap and first loop-type material located on said second side of said ankle strap adjacent to said second end of said ankle strap;

a first adjustable length foot strap attached to said ankle strap; and said fifth ring element attached to said ankle strap for positioning on the outer side of the leg and above the ankle of said user when said foot attachment means is worn by said user.

11. Apparatus as in claim 10 wherein said first foot attachment means further includes:

first and second slide holder elements attached to said ankle strap;

said foot strap defining first and second opposed sides and defining first and second ends;

second hook-type material located adjacent to said first end and on said first side of said foot strap and second loop-type material located adjacent to said second hook-type material and on said first side of said foot strap;

a slide fastener connected to said second end of said foot strap; and said first end of said foot strap slidably passing through said first slide holder, through said slide fastener and through said second slide holder with said second hook-type material attachable to said second loop-type material, whereby the overall length of said foot strap can be adjusted by adjustable movement of said slide fastener with respect to said foot strap.

12. Apparatus as in claim 1 wherein said belt means defines an outer surface and wherein said first and second ring elements are attached to said outer surface of said belt means for positioning above the illium on each side of the user, respectively, when said belt means is worn by the user and further including a seventh ring element attached to said outer surface of said belt means for positioning substantially in the center of the lower back of the user when said apparatus is worn by said user.

13. Apparatus as in claim 12 further including eighth and ninth ring elements attached to said first and second foot attachments, respectively;

a third stretchable cord of predetermined normal length; and fifth and sixth connecting elements attached to said third cord for removable attachment of said fifth connecting element to said eighth ring element and for passing said third cord through said seventh ring element to be stretched and removably attached by said sixth connecting element to said ninth ring element.

14. Apparatus as in claim 12 further including first and second ring members attached to said outer surface of said belt means for respective positioning on each side and above the hips of the user when said belt means is worn by said user.

15. Apparatus as in claim 1 further including first and second adjustable suspender straps attached to said belt means for fitting over the shoulders of the user.

16. Apparatus as in claim 15 further including additional ring elements, one each of said additional ring elements attached above the heel of each of said athletic shoes.

17. Apparatus as in claim 1 wherein said first and second foot attachment means are athletic shoes.

18. Exercise apparatus, comprising:

belt means for adjustable and removable attachment about the waist or mid-section of a human user of said apparatus;

first and second ring elements attached to said belt means for positioning above the illium on each side of the user, respectively, when said belt means is worn by the user;

first and second strap means for adjustable and removable attachment about the legs and above the knees of said user;

third and fourth ring elements attached to said first and second strap means, respectively for positioning on outer sides of the legs when said strap means are worn by the user;

first and second foot attachment means for removable attachment to the feet of said user;

fifth and sixth ring elements attached to said first and second foot attachments, respectively for positioning on outer sides of the ankles when said foot attachment means are worn by the user;

a first stretchable cord of predetermined normal length;

first and second connecting elements attached to said first cord for removable attachment of said first connecting element to said fifth ring element and for passing said first cord upwardly through said third ring element to be stretched and removably attached by said second connecting element to said first ring element;

a second stretchable cord of predetermined normal length; and third and fourth connecting elements attached to said second cord for removable attachment of said third connecting element to said sixth ring element and for passing said second cord upwardly through said fourth ring element to be stretched and removably attached by said fourth connecting element to said second ring element.

* * * * *